US009091127B2

(12) United States Patent
Olsen

(10) Patent No.: US 9,091,127 B2
(45) Date of Patent: Jul. 28, 2015

(54) SAFETY JOINT AND RISER

(75) Inventor: Robert Olsen, Stavanger (NO)

(73) Assignee: Vetco Gray Scandinavia AS, Sandvika (NO)

( * ) Notice: Subject to any disclaimer, the term of this patent is extended or adjusted under 35 U.S.C. 154(b) by 102 days.

(21) Appl. No.: 13/307,838

(22) Filed: Nov. 30, 2011

(65) Prior Publication Data

US 2012/0132433 A1 May 31, 2012

(30) Foreign Application Priority Data

Nov. 30, 2010 (NO) ..... 20101681

(51) Int. Cl.

| | |
|---|---|
| ***E21B 17/01*** | (2006.01) |
| ***E21B 17/02*** | (2006.01) |
| ***E21B 17/08*** | (2006.01) |
| ***E21B 17/06*** | (2006.01) |
| ***E21B 19/00*** | (2006.01) |

(52) U.S. Cl.

CPC ..... *E21B 17/085* (2013.01); *E21B 17/06* (2013.01); *E21B 19/006* (2013.01)

(58) Field of Classification Search

USPC ..... 166/338, 340, 344, 345, 346, 350, 351, 166/359, 363, 364, 367; 285/1, 2; 137/68.14, 68.15

See application file for complete search history.

(56) References Cited

U.S. PATENT DOCUMENTS

| | | | | |
|---|---|---|---|---|
| 5,382,056 | A * | 1/1995 | Milberger | 285/1 |
| 6,557,637 | B1 * | 5/2003 | Dore et al. | 166/338 |
| 7,040,406 | B2 * | 5/2006 | Dore et al. | 166/338 |
| 2008/0105435 | A1 * | 5/2008 | Inderberg | 166/363 |
| 2012/0048566 | A1 * | 3/2012 | Coppedge et al. | 166/340 |
| 2012/0067589 | A1 * | 3/2012 | Fenton | 166/340 |
| 2012/0132430 | A1 * | 5/2012 | Ebenezer | 166/340 |

FOREIGN PATENT DOCUMENTS

| | | | | |
|---|---|---|---|---|
| CA | 738301 | A | 7/1966 | |
| EP | 1 378 626 | A2 | 1/2004 | |
| WO | 01/86110 | A1 | 11/2001 | |
| WO | 2004/113158 | A2 | 12/2004 | |
| WO | 2006/033580 | A1 | 3/2006 | |
| WO | WO 2006/025744 | A1 | 3/2006 | |
| WO | WO 2010/090531 | A1 | 8/2010 | |
| WO | WO 2010090531 | A1 * | 8/2010 | E21B 17/08 |

OTHER PUBLICATIONS

GB Search Report, Application No. GB1120094.6, Dated Dec. 6, 2011, Dr. Lyndon Ellis.

Norwegian Search Report from Norwegian App. No. 20101681, dated Jun. 30, 2011, 2 pages.

* cited by examiner

*Primary Examiner* — James G Sayre

(74) *Attorney, Agent, or Firm* — Bracewell & Giuliani LLP

(57) ABSTRACT

A safety joint to be included in a riser between a floating structure and a subsea installation at a location in the riser above a stress joint where it will be subjected to minimum bending loads. The safety joint includes a first riser coupling at its upper end for connection to a corresponding riser coupling of a riser joint and a second riser coupling at its lower end for connection to a corresponding riser coupling of a riser joint or stress joint. An emergency disconnect package with an emergency disconnect coupling and a retainer valve unit is arranged between the upper end and the lower end of the safety joint. A riser including such a safety joint.

20 Claims, 4 Drawing Sheets

SAFETY JOINT AND RISER

CROSS-REFERENCE TO RELATED APPLICATION

This application claims priority to and the benefit of co-pending Norwegian Application No, 20101681, by Robert Olsen, filed on Nov. 30, 2010, entitled "SAFETY JOINT AND RISER COMPRISING SUCH A SAFETY JOINT," which application is incorporated, herein by reference.

FIELD OF THE INVENTION

The present invention relates to a safety joint according to the preamble of claim 1 to be included in a riser between a floating structure and a subsea installation. The invention also relates to a riser comprising such a safety joint.

BACKGROUND OF THE INVENTION

Development within offshore oil and gas exploration in the recent years has been directed to subsea installations for processing and transport of oil and gas. The subsea installation is located at the well on the seabed and is connected to a floating structure by means of a so-called riser, which constitutes a conduit between the subsea installation and the floating structure. The subsea installation may be a wellhead or other type of equipment positioned on the seabed or in a fixed position above the seabed. The floating structure may for instance be a vessel. Movements of the floating structure due to waves, wind and sea-currents can cause bending of the riser and influence the tension thereof. The riser is designed to be capable of withstanding a certain amount of bending and tension encountered during normal conditions. However, in an emergency situation, for instance due to severe weather conditions, the riser might be subjected to excessive bending and tensioning with a risk of damage to the riser and to the equipment connected to the riser. In order to avoid such damage, a so-called emergency disconnect package can be used to disconnect the riser from the subsea installation in an emergency situation or if the operator predicts that adverse conditions are imminent. The emergency disconnect package is traditionally secured to the subsea installation below a stress joint provided at the lower end of the riser. Such an arrangement is for instance disclosed in U.S. Pat. No. 6,659,690 B1 and WO 2008/051092 A1. When the riser has to be disconnected from the subsea installation in an emergency situation, the emergency disconnect package is actuated to release the stress joint and the riser from the subsea installation. Normally, the riser also comprises a safety joint provided with a weak link that will automatically break when subjected to an excessive axial force. Such a safety joint may be located at the base of the stress joint or connected between the stress joint and the lowermost riser joint or between two riser joints at the lower end of the riser.

The safety joint of the present invention is particularly intended to be used in a completion and work over riser. A completion and work over riser is used in the oil and gas industry when oil and/or gas is to be extracted from one or more offshore wells. Completion and work over operations are performed on a subsea wellhead using a completion and work over riser. A completion and work over riser may for instance be used for installing or retrieving a so-called X-mas tree. It may also be used for installing or pulling a so-called tubing hanger. With a dual bore riser it will be possible to circulate a fluid down through the production pipe and up through the annulus pipe or vice versa. Such fluid circulation may be used to clean a well and to test and verify a circulation path. The bore of the production pipe and the bore of the annulus pipe of a dual bore riser may be connected to two corresponding bores in an X-mas tree so that a wire line or coiled tubing can be used to access plugs or other devices installed in the bores of the X-mas tree. The bore of the production pipe of a riser may also be connected to the production tubing that extends from a tubing hanger all the way to the bottom of a well. Installing the tubing and tubing hanger is referred to as completing a well and is consequently a completion operation. When a well is completed, it is made ready for production of oil and/or gas or alternatively for injection of gas or water. If the well does not produce as expected, it may be overhauled or repaired in different ways. This is referred to as work over.

A completion and work over riser may be of the monobore type or the dual bore type. A dual bore riser comprises a production pipe and an annulus pipe extending in parallel with the production pipe. The production pipe is typically designed for taking a load and has strength for lifting, whereas the annulus pipe may be a pressure containing pipe with no strength for lifting. A monobore riser comprises a production pipe but no annulus pipe.

SUMMARY OF THE INVENTION

The object of the present invention is to provide a new and advantageous safety arrangement for disconnection of a riser from a subsea installation, which in at least some aspect offers an advantage as compared to previously known safety arrangements.

According to the invention, this object is achieved by a safety joint having the features defined in claim 1.

The safety joint of the present invention is to be included in a riser between a floating structure and a subsea installation and comprises:

- a first riser coupling at its upper end for connection to a corresponding riser coupling of a riser joint;
- a second riser coupling at its lower end for connection to a corresponding riser coupling of a riser joint or stress joint; and
- an emergency disconnect package with an emergency disconnect coupling arranged between the upper end and the lower end of the safety joint.

The safety joint of the present invention is to be located in a riser above the stress joint which connects the riser to the subsea installation in question. By providing the emergency disconnect package in this safety joint above the stress joint and not at the conventional spot below the stress joint, the disconnection point of the riser string is moved to a location where it has appeared that the tensile load is the dominant load even when the floating structure is offset to a large extent in the horizontal direction. At the conventional location for the emergency disconnect package below the stress joint, the emergency disconnect package is subjected to high bending moments, which requires the use of a rather complex and bulky emergency disconnect coupling designed to be capable of disconnecting even when subjected to high bending moments. With the location of the emergency disconnect package in a safety joint above the stress joint, it will be possible to use a more simple and slim emergency disconnect coupling with limited capability of disconnecting under high bending moments. Hereby, it will be possible to give the emergency disconnect package such a compact and slim design that the safety joint provided with the emergency disconnect package can pass through a conventionally sized drill floor opening of a floating structure.

According to an embodiment of the invention, the emergency disconnect package also comprises a retainer valve unit arranged in series with the emergency disconnect coupling between the upper end and the lower end of the safety joint.

According to an embodiment of the invention, the safety joint also comprises a weak link arranged in series with the emergency disconnect package between the upper end and the lower end of the safety joint. Hereby, the riser will be automatically disconnected from the subsea installation when subjected to an excessive tensile force.

The weak link is preferably arranged between the emergency disconnect package and the lower end of the safety joint. Hereby, in case the weak link is broken, a possible retainer valve unit included in the emergency disconnect package could prevent pressurized fluid in the riser above the safety joint from becoming a jet that may introduce undesirable and dangerous movements to the part of the riser which is left hanging from the floating structure.

Further advantages as well as advantageous features of the safety joint of the present invention will appear from the following description and the dependent claims.

The invention also relates to a riser having the features defined in claim 9.

BRIEF DESCRIPTION OF THE DRAWINGS

With reference to the appended drawings, a specific description of preferred embodiments of the invention cited as examples follows below. In the drawings.

DETAILED DESCRIPTION OF THE INVENTION

Figure 1:
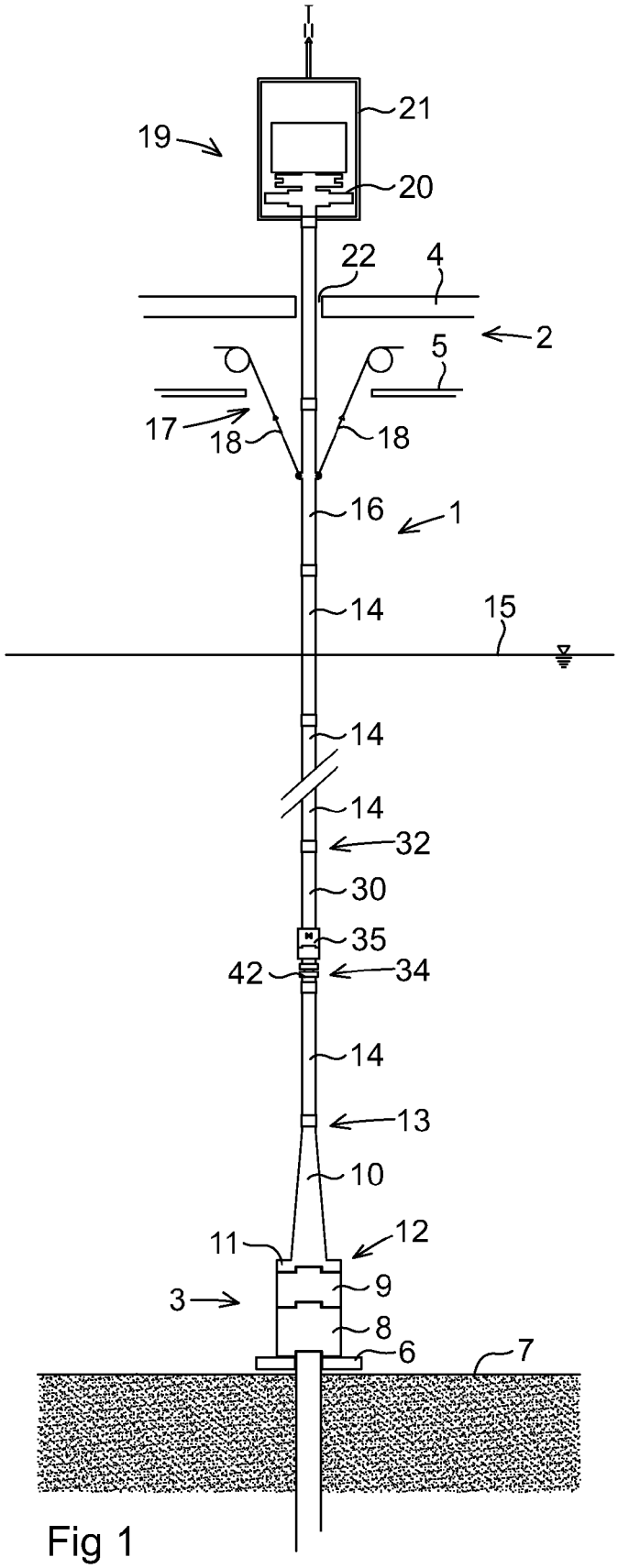
FIG. 1 is a schematic illustration of a riser arranged between a subsea installation and a floating structure.
Figure 1A:
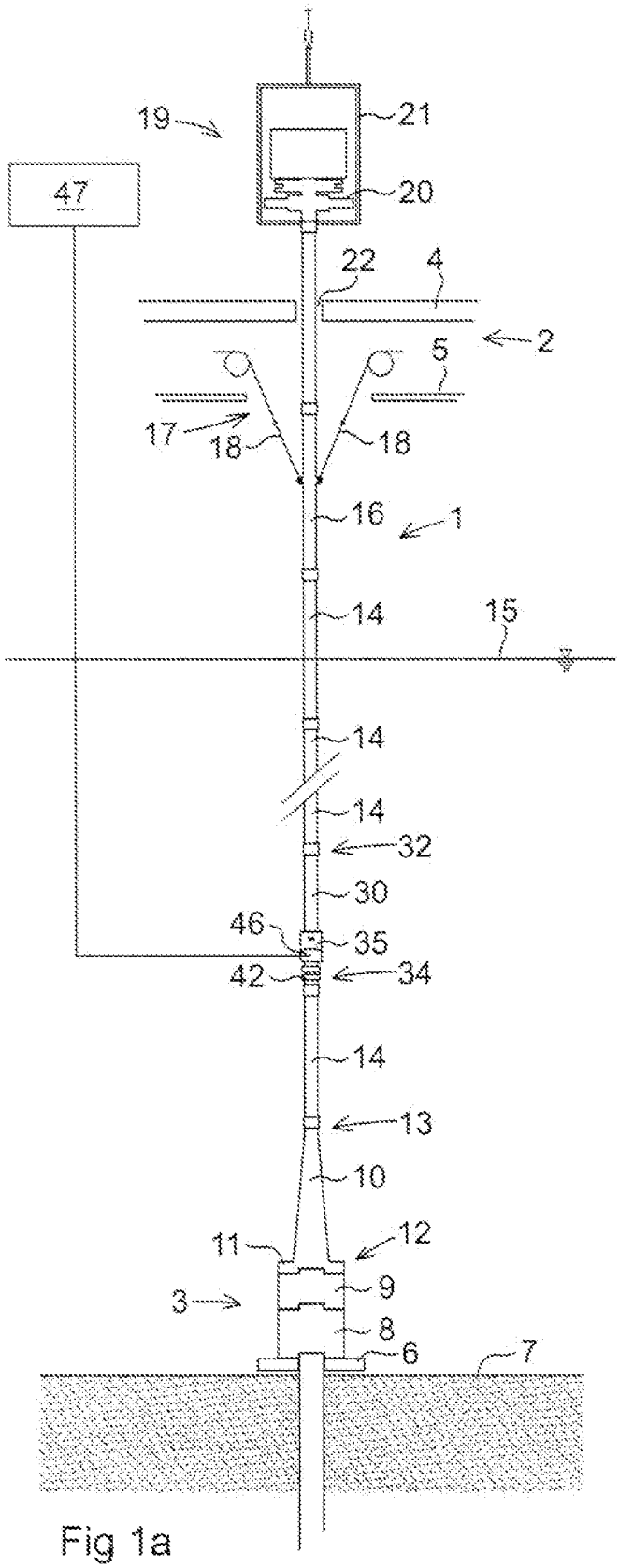
FIG. 1*a* is a schematic illustration of a riser arranged between a subsea installation and a floating structure.
Figure 1B:
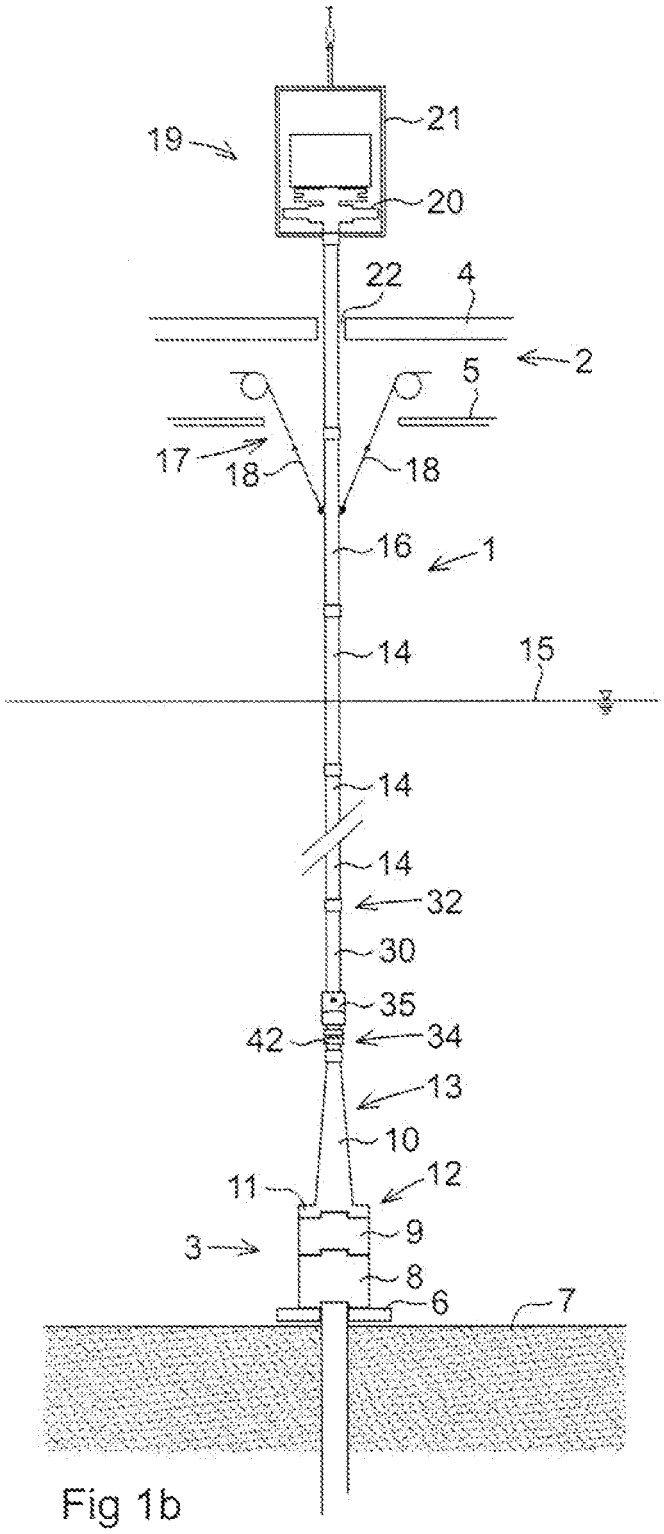
FIG. 1*b* is another schematic illustration of a riser arranged between a subsea installation and a floating structure.

FIGS. 1*a*-1*b* show a safety joint 30 according to the present invention arranged in a riser 1 which extends between a floating structure 2 and a subsea installation 3. In the illustrated example, the riser 1 is a completion and work over riser. The floating structure 2 is for instance a vessel and only parts thereof are illustrated very schematically in FIGS. 1*a*-1*b*. The illustrated parts of the floating structure 2 are a drill floor 4 and a cellar deck 5. In the illustrated example, the subsea installation 3 comprises a guide base 6 resting on the seabed 7 and a subsea tree 8 supported on the guide base. A well control package 9 is mounted to the subsea tree.

The riser 1 comprises a stress joint 10 at its lower end, through which the riser is connected to the subsea installation 3. The stress joint 10 has a flange 11 at its lower end 12, which flange is secured to an upper part of the well control package 9. The stress joint 10 tapers as seen from its wider lower end 12 towards its narrower upper end 13 and provides a gradual transition from the relatively compliant riser to the much stiffer well control package 9. The stress joint 10 is provided with a riser coupling at its upper end 13 for connection to a corresponding riser coupling of a riser joint 14 or safety joint 30.

The riser 1 extends above sea level 15 and comprises a tension joint 16 at its upper end. A riser tensioner 17 arranged on the floating structure 2 is provided with tension wires 18 connected to the tension joint 16. The riser tensioner 17 is used to tension the riser 1 through the tension wires 18 in order to provide a desired tension in the riser 1. At its upper end, the riser 1 is connected to equipment 19 arranged on the floating structure 2. In the illustrated example, this equipment comprises a surface tree 20 arranged in a tension frame 21.

The above-mentioned safety joint 30 and a number of conventional riser joints 14 are connected to each other and arranged in series with each other between the stress joint 10 and the tension joint 16 in order to form a conduit between the subsea installation 3 and the floating structure 2. The safety joint 30 of the present invention is of a design that allows it to be located at an elevation where it will be exposed to minimum bending loads, typically one or two riser joints above the stress joint 10.

Figure 2:
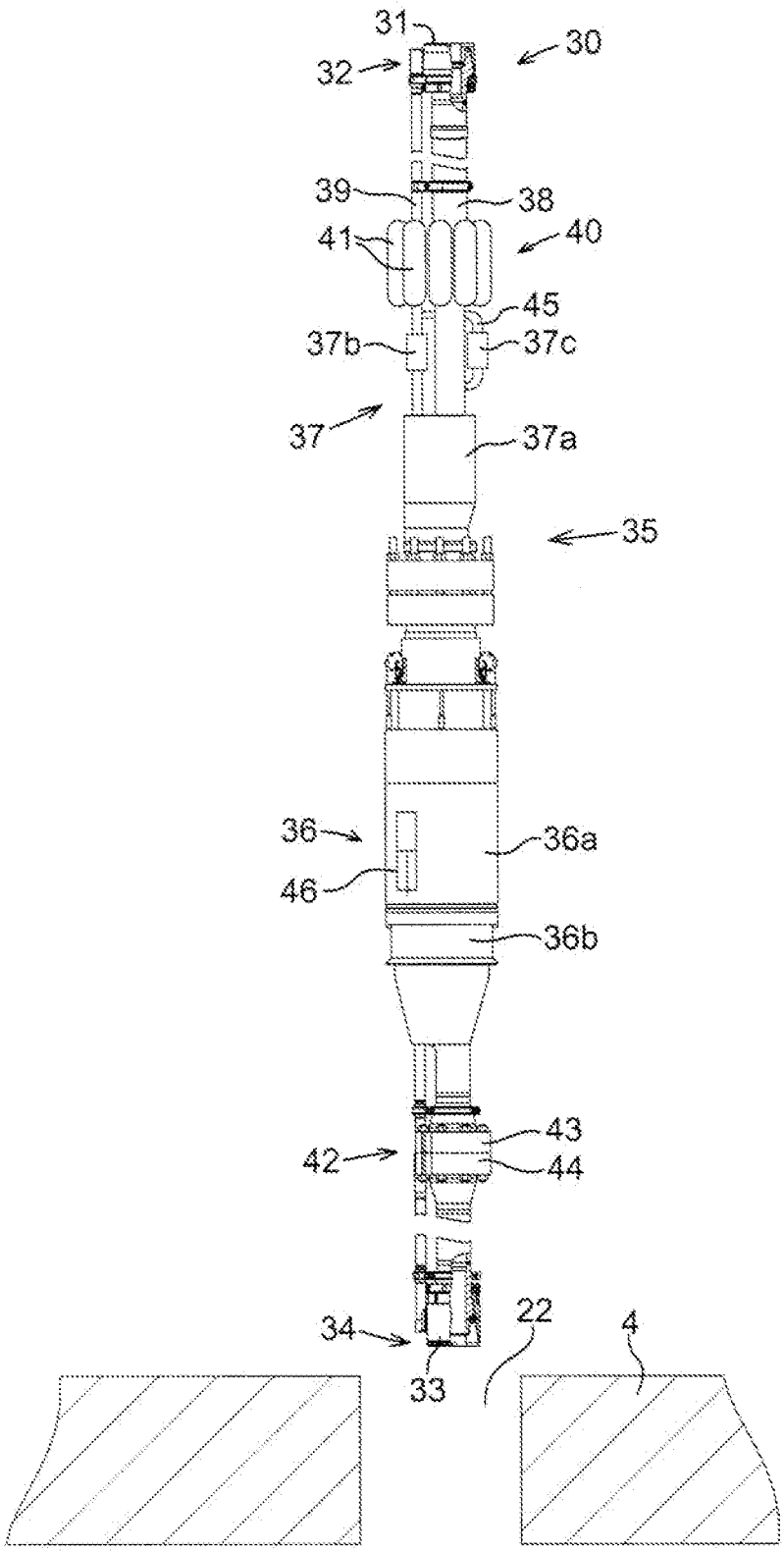
FIG. 2 is a schematic lateral view of a safety joint according to an embodiment of the present invention.

The safety joint 30, which is illustrated in closer detail in FIG. 2, comprises a first riser coupling 31 at its upper end 32 for connection to a corresponding riser coupling of a riser joint 14 and a second riser coupling 33 at its lower end 34 for connection to a corresponding riser coupling of a riser joint 14 or stress joint 10. An emergency disconnect package 35 is arranged between the upper end 32 and the lower end 34 of the safety joint. In the illustrated embodiment, the emergency disconnect package 35 comprises an emergency disconnect coupling 36 and a retainer valve unit 37 arranged in series with each other. The retainer valve unit 37 is with advantage arranged above the emergency disconnect coupling 36, i.e., between the emergency disconnect coupling 36 and the upper end 32 of the safety joint, as illustrated in FIG. 2. However, the retainer valve unit 37 may alternatively be arranged below the emergency disconnect coupling 36, i.e. between the emergency disconnect coupling 36 and the lower end 34 of the safety joint.

The emergency disconnect coupling 36 is of such size that it is able to pass through a conventionally sized drill floor opening 22 in the drill floor 4. The emergency disconnect coupling 36 has an upper coupling part 36*a* and a lower coupling part 36*b* which are releasable from each other by means of an actuator 46. This actuator 46 is remote-controlled and triggered by means of an electric or hydraulic control signal transmitted from a control unit 47 provided on the floating structure 2. Thus, the actuator 46 is configured to disconnect the upper coupling part 36*a* from the lower coupling part 36*b* when receiving a control signal from the control unit 47 provided on the floating structure 2. The actuator 46 is with advantage a hydraulic actuator 46. The emergency disconnect coupling 36 could for instance be a VetcoGray WITS connector or any other suitable type of connector.

The retainer valve unit 37 is also of such size that it is able to pass through a conventionally sized drill floor opening 22 in the drill floor 4. In case of a dual bore riser, the retainer valve unit 37 comprises a first retainer valve 37*a* for closing the production pipe 38 and a second retainer valve 37*b* for closing the annulus pipe 39. In case of a monobore riser, the retainer valve unit 37 only comprises one retainer valve. The retainer valves 37*a*, 37*b* are normally maintained open. In an emergency situation, the retainer valves 37*a*, 37*b* are closed immediately before the disconnection of the emergency disconnect coupling 36 to thereby prevent the fluid contained in the riser above the safety joint 30 from being released to the sea. The respective retainer valve 37*a*, 37*b* is actuated by means of an actuator 46. This actuator 46 is with advantage a hydraulic actuator 46 and triggered by means of an electric or hydraulic control signal transmitted from a control unit 47 provided on the floating structure 2. Thus, the actuator 46 is configured to close the associated retainer valve when receiving a control signal from the control unit 47 provided on the floating structure 2. The production pipe retainer valve 37*a* could for instance be a VetcoGray WITS retainer valve or any other suitable type of retainer valve.

In case of a dual bore riser, a circulation valve 37*c* may be arranged in a conduit 45 extending between the production pipe 38 and the annulus pipe 39, which conduit 45 has a first end connected to the bore of the annulus pipe 39 above the annulus pipe retainer valve 37*b* and a second end connected to the bore of the production pipe 38 above the production pipe retainer valve 37*a*. The circulation valve 37*c* is normally maintained closed and can be opened subsequent to the closing of the production pipe retainer valve 37*a* and the annulus pipe retainer valve 37*b* to thereby open a communication between the bore of the production pipe 38 and the bore of the annulus pipe 39 near the lower end of the disconnected part of the riser. Sea water or any other environmentally safe fluid can then be pumped down the annulus pipe 39 to lift the trapped fluid in the production pipe 38 back to the floating structure 2 for processing and/or discard. When the riser is filled with sea water it can be disassembled and pulled back to the floating structure or be left in its prevailing position awaiting a later reconnection of the emergence disconnect coupling 36. The circulation valve 37*c* is actuated by means of an actuator 46. This actuator 46 is with advantage a hydraulic actuator 46.

The safety joint 30 is also provided with an accumulator unit 40, which comprises one or several accumulators 41 for accumulating hydraulic fluid under pressure. In the embodiment illustrated in FIG. 2, the accumulator unit 40 comprises several accumulators 41 arranged in a ring around the production pipe 38 and annulus pipe 39. The hydraulic actuator 46 of the emergency disconnect coupling 36 is connected to the accumulator unit 40 in order to allow hydraulic fluid under pressure to be supplied from the accumulator unit 40 to the hydraulic actuator 46 when the hydraulic actuator 46 is to release the two coupling parts 36*a*, 36*b* of the emergency disconnect coupling 36 from each other. The hydraulic actuator 46 of the respective valve 37*a*, 37*b*, 37*c* included in the retainer valve unit 37 is also connected to the accumulator unit 40 to allow the position of the respective retainer valve 37*a*, 37*b* and the circulation valve 37*c* to be controlled by means of pressurized fluid from the accumulator unit. As an alternative, pressurized. hydraulic fluid could be supplied to the above-mentioned actuators from suitable equipment on the floating structure 2.

Furthermore, the safety joint 30 comprises a weak link 42 arranged in series with the emergency disconnect package 35 between the upper end 32 and the lower end. 34 of the safety joint. The weak link 42 is preferably arranged between the emergency disconnect package 35 and the lower end 34 of the safety joint, as illustrated in FIGS. 1 and 2. However, the weak link 42 may alternatively be arranged between the emergency disconnect package 35 and the upper end 32 of the safety joint. The weak link 42 is designed to automatically break when subjected to a tensile force exceeding a predetermined limit. Thus, the weak link 42 forms a weakened section of the safety joint 30. In the embodiment illustrated in FIG. 2, the weak link 42 comprises an upper flange 43 and a lower flange 44 bolted to each other by means of bolts provided with a reduced cross-section having a calibrated breaking strength. The weak link may alternatively be formed by a section of the production pipe 38 that has been machined down to form a weakened section that will break at a predetermined load. The weak link may also be of any other suitable type.

The retainer valves 37*a*, 37*b* of the retainer valve unit 37 are with advantage arranged to automatically close when the weak link 42 is broken. This could be achieved by designing the respective retainer valve 37*a*, 37*b* as a fail-safe-close valve and looping the hydraulic control lines between the accumulator unit 40 and the retainer valve through the weak link 42. Hereby, the hydraulic pressure needed to maintain the retainer valves 37*a*, 37*b* open will disappear when the weak link 42 is broken and the retainer valves will then be automatically closed.

The safety joint 30 is preferably designed to fit within a cylindrical space having a diameter of 49½ inch (1257.3 mm), or alternatively 60½ inch (1536.7 mm), so as to thereby be able to pass through a conventionally sized drill floor opening 22.

One or more riser joints 14 may be provided between the stress joint 10 and the safety joint 30. In the example illustrated in FIGS. 1*a*-1*b*, one riser joint 14 is connected between the stress joint 10 and the safety joint 30. However, the safety joint 30 may alternatively be connected directly to the stress joint 10 as illustrated in FIG. 1*b*, i.e. with the riser coupling 33 at the lower end 34 of the safety joint connected directly to the riser coupling at the upper end 13 of the stress joint 10.

The lower part of the safety joint 30 up to and including the lower coupling part 36*b* of the emergency disconnect coupling 36 may be used as the top end of a subsea lubricator tube. A work over riser may then be connected to the subsea lubricator stack through a riser string provided with the remaining part of the safety joint 30 at its lower end.

The invention is of course not in any way restricted to the embodiments described above. On the contrary, many possibilities to modifications thereof will be apparent to a person with ordinary skill in the art without departing from the basic idea of the invention such as defined in the appended claims.

What is claimed is:

1. A safety joint to be included in a riser between a floating structure and a subsea installation, the safety joint comprising:

a first riser coupling at an upper end of the safety joint for connection to a corresponding riser coupling of a riser joint;

a second riser coupling at a lower end of the safety joint for connection to a corresponding riser coupling of a riser joint or stress joint; and an emergency disconnect package having an emergency disconnect coupling arranged between the upper end and the lower end of the safety joint, the emergency disconnect coupling having an upper coupling part and a lower coupling part that disconnect upon command from an actuator;

the emergency disconnect coupling being positioned at a location where it will be subjected to minimum bending loads.

2. The safety joint of claim 1, wherein the safety joint further comprises a weak link configured to automatically break when subjected to a tensile force exceeding a predetermined limit.

3. The safety joint of claim 2, wherein the weak link is located below the emergency disconnect coupling, and wherein the emergency disconnect package further comprises a retainer valve unit arranged in series with the emergency disconnect coupling between the upper end and the lower end of the safety joint, and wherein the retainer valve unit is arranged between the emergency disconnect coupling and the upper end of the safety joint.

4. The safety joint of claim 1, wherein the safety joint further comprises a weak link configured to automatically break when subjected to a tensile force exceeding a predetermined limit, and wherein the weak link is arranged separate from and in longitudinal series with the emergency disconnect coupling of the emergency disconnect package between the upper end and the lower end of the safety joint.

5. The safety joint of claim 4, wherein the weak link is arranged between the emergency disconnect package and the lower end of the safety joint, and below the emergency disconnect coupling adjacent the lower end of the safety joint.

6. The safety joint of claim 1, wherein the safety joint comprising the emergency disconnect coupling is located one or two riser joints above the stress joint.

7. The safety joint of claim 1, wherein the actuator is a remote-controlled actuator, wherein the upper coupling part and lower coupling art of the emergency disconnect coupling are releasable from each other by means of the remote-controlled actuator, and wherein said actuator is a hydraulic actuator.

8. The safety joint of claim 7, wherein the safety joint has an accumulator unit comprising one or more accumulators for accumulating hydraulic fluid under pressure, the hydraulic actuator of the emergency disconnect coupling being connected to said accumulator unit in order to allow hydraulic fluid under pressure to be supplied from the accumulator unit to the hydraulic actuator when the hydraulic actuator is to release the upper and lower coupling parts of the emergency disconnect coupling from each other.

9. The safety joint of claim 1, wherein the safety joint is sized and arranged to fit within a cylindrical space having a diameter of 49½ inch (1257.3 mm) to thereby provide for deployment through a drill floor opening of a floating structure.

10. The safety joint of claim 1, wherein the safety joint is sized and arranged to fit within a cylindrical space having a diameter of 60½ inch (1536.7 mm) to thereby provide for deployment through a drill floor opening of a floating structure.

11. The safety joint of claim 1, wherein the actuator is a remote-controlled actuator.

12. A riser extending between a floating structure and a subsea installation, the riser comprising:

a stress joint at a lower end of the riser; and a safety joint located above the stress joint at the lower end of the riser, wherein the safety joint comprises:

a first riser coupling at an upper end of the safety joint for connection to a corresponding riser coupling of a riser joint;

a second riser coupling at a lower end of the safety joint for connection to a corresponding riser coupling of a riser joint or the stress joint;

an emergency disconnect package having an emergency disconnect coupling releasable by an actuator and arranged between the upper end and the lower end of the safety joint at a location having a minimal bending moment; and a weak link configured to automatically break when subjected to a tensile force exceeding a predetermined limit, the weak link arranged in series with the emergency disconnect package between the upper end and the lower end of the safety joint.

13. The riser of claim 12, wherein one or more riser joints are provided between the stress joint and the safety joint.

14. The riser of claim 12, wherein the safety joint is connected directly to the stress joint.

15. The riser of claim 12, wherein the riser is a completion and work over riser, and wherein the actuator is a hydraulic actuator.

16. The riser of claim 12, wherein the safety joint is sized and arranged to fit within a cylindrical space having a diameter of 49½ inch (1257.3 mm) to thereby provide for deployment through a drill floor opening of a floating structure.

17. The riser of claim 12, wherein the safety joint is sized and arranged to fit within a cylindrical space having a diameter of 60½ inch (1536.7 mm) to thereby provide for deployment through a drill floor opening of a floating structure.

18. The riser of claim 12, wherein the safety joint further comprises a weak link, and wherein the weak link is arranged in series with the emergency disconnect package between the upper end and the lower end of the safety joint.

19. The riser of claim 12, wherein the location having a minimal bending moment is a location in the riser above the stress joint where the safety joint will be subjected to minimum bending loads.

20. The riser of claim 12, wherein the actuator is a remote-controlled actuator, and wherein the emergency disconnect coupling has two coupling parts that are releasable from each other by means of the remote-controlled actuator.

* * * * *